United States Patent [19]

Kovacs

[11] 3,961,510

[45] June 8, 1976

[54] TENSION DEVICE FOR A ROLLING MILL AND THE LIKE

[75] Inventor: Daniel Charles Kovacs, Pittsburgh, Pa.

[73] Assignee: Wean United, Inc., Pittsburgh, Pa.

[22] Filed: July 11, 1975

[21] Appl. No.: 595,195

[52] U.S. Cl. ..... 72/20; 72/205

[51] Int. Cl.[2] ..... B21B 37/06; B21B 39/08

[58] Field of Search ..... 72/6, 20, 21, 19, 205, 72/17, 18

[56] References Cited

UNITED STATES PATENTS

| | | | |
|---|---|---|---|
| 3,169,420 | 2/1965 | Stone et al. | 72/6 |
| 3,169,421 | 2/1965 | Bloodworth | 72/6 |
| 3,237,439 | 3/1966 | Torrance | 72/205 |

*Primary Examiner*—Milton S. Mehr

*Attorney, Agent, or Firm*—Daniel Patch; Henry C. Westin

[57] ABSTRACT

The disclosure of this application relates to a looper device employed to impose a constant tension on a strip as it passes between the stands of a tandem rolling mill. The looper is operated by an hydraulic actuator which is controlled by a computer controlled hydraulic servosystem. The computer is fed a signal of the position of the looper and calculates the required pressure difference across the actuator for a desired tension.

5 Claims, 4 Drawing Figures

TENSION DEVICE FOR A ROLLING MILL AND THE LIKE

As in the past, many present day tandem rolling mills employ a looper roller assembly in an effort to obtain constant interstand tension which is essential to the production of uniform gauge strip. Looper devices presently employed in hot and cold tandem rolling mills may take several different forms as far as the power means employed to operate the looper roller and the control system for attempting to obtain a desired constant strip tension is concerned.

The previous power means which comprised electrical, mechanical, hydraulic or pneumatic devices or a combination of some of these all involved inherent limitations and disadvantages with respect to response time, maintenance and static and dynamic tension variations, as well as requiring a large amount of space where space is at a premium.

The present invention has for its primary object providing an actuator and control system for a looper device which will greatly improve the operation, and reliability of the looper in a very economical manner.

More particularly, the actuator and control system of the present invention has as its object providing a very simple system, low in inertia, characterized by being very compact and allowing modular construction of components and further allowing the fluid system to be remotely located and one in which the relationship between the fluid pressure is linear with respect to torque and in which the fluid system is leakage self-compensating.

Still more particularly, the present invention provides an hydraulic actuated servocontrolled looper device wherein the power means for the looper roller consists of an hydraulic actuator which is supplied fluid by a computer controlled servosystem, the computer receiving a signal representative of the position of the looper roller relative to the strip and computes the required pressure that must be exerted by the actuator to give a desired tension for the particular looper position.

A still further object of the present invention is to provide maximum system pressure to the one side of the hydraulic actuator and provide for a servovalve to regulate the pressure on the other side of the actuator in accordance with a signal from a computer which calculates the required pressure difference across the actuator for a desired tension, in which the computer signal is modified, if necessary, by signals representing the actual pressures on the opposite sides of the actuator, which signals are compared with the calculated computer signal representing the desired tension.

These objects as well as the other novel features and advantages of the present invention will become more apparent when the following description of one embodiment thereof is read along with the accompanying drawings of which:

Figure 1:
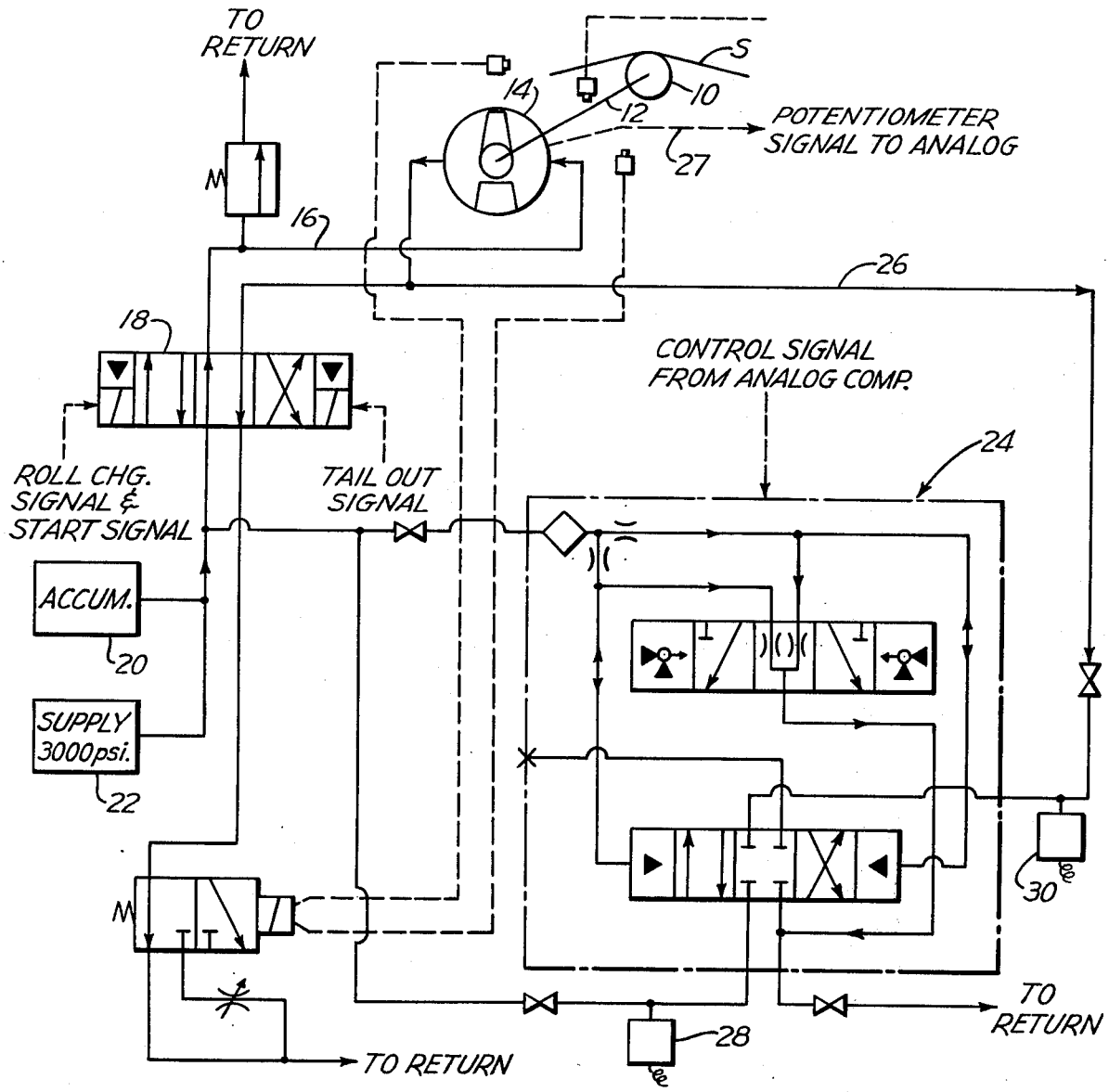
FIG. 1 is a schematic diagram of the principal electrical and hydraulic components of a strip tensioning device constructed in accordance with the teaching of the present invention.

Since strip tensioning devices, generally referred to as strip loopers or tensiometers, are well known in the rolling mill art, only those aspects that are necessary to understand the present invention have been shown in the drawings and will be referred to in the description of the illustrated embodiment of the present invention. For a ready reference to the general use, basic theory and general equations of strip loopers, reference is made to U.S. Pat. No. 3,169,420 dated Feb. 16, 1965.

With this in mind reference will be first made to FIG. 1, where there is shown a portion of a continuous moving strip S being deflected upwardly by a looper roller 10 which is connected by a torque arm 12 to an hydraulic rotary actuator 14. The actuator 14, which comprises an important aspect of the present invention, may follow several well-known forms, one example of which is the HOUDAILLE HYD-RO-AC supplied by the Hydraulics Division, Houdaille Industries, Inc. of Buffalo, New York. The unit 14 is meant to typify a single vane type actuator. In addition to the compactness, high efficiency and modular capabilities of this unit, it commends itself to the looper system because of its ability to deliver for a given hydraulic pressure a linear tortional force and because it can be made leakage self-compensating, both of which characteristics not only greatly simplify the controls, but also assure an high degree of accuracy.

The maximum pressure side of the actuator 14 is connected by a line 16 to a three position solenoid valve 18 associated with an accumulator 20 and pumping station 22 which in the drawing is legend to deliver 3,000 psi. The other side or vane of the actuator 14, which is the low pressure side, is connected to a servovalve 24 by a line 26, the servovalve functioning to regulate the pressure of the actuator on this side in accordance with a control signal from a computer, which input signal is legend in FIG. 1. This hydraulic system is leakage compensating with respect to the actuator 14, since the pressure difference across the actuator as determined by the difference in pressure over lines 16 and 26 is controlled and not just the input pressure of the actuator. This also allows for compensation of such items as seal wear, thereby providing an high accuracy between the control signal, actuator and strip tension. The servovalve 24 illustrated in FIG. 1 follows several well-known types, the one illustrated intends to typify an HIGH FLOW Two Stage servovalve Series 72 supplied by the MOOG INC., CONTROLS DIVISION, of East Aurora, New York.

There has also been illustrated in FIG. 1, both with respect to the valves 18 and 24 and otherwise, some of the usual auxiliary hydraulic and electrical control elements which do not require specific notation. It is important to note, however, that associated with the two sides of the actuator 14, i.e., the high and low pressure sides, there are provided two pressure transducers 28 and 30, respectively. As will become more evident later on, signals from these transducers are fed back to the computer for comparison and, if necessary, modification of the ultimate control signal being sent to the servovalve 24. Before leaving FIG. 1, it should be noted that the vertical position of the looper roller 10 relative to a datum reference point, such as, horizontal pass line of FIG. 2, is measured by a potentiometer 27 and a signal representative thereof is sent to the computer.

Figure 2:
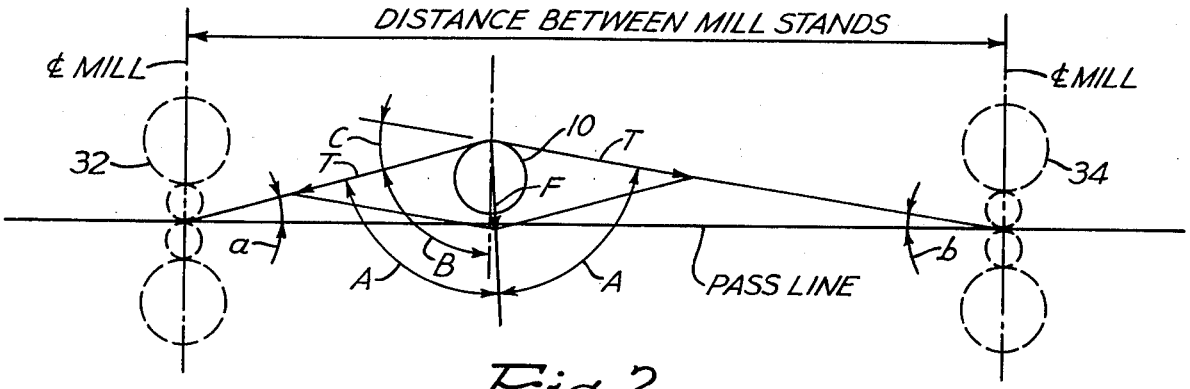
FIG. 2 is a force diagram of the applied force of the looper and the tension in the strip.
Figure 3:
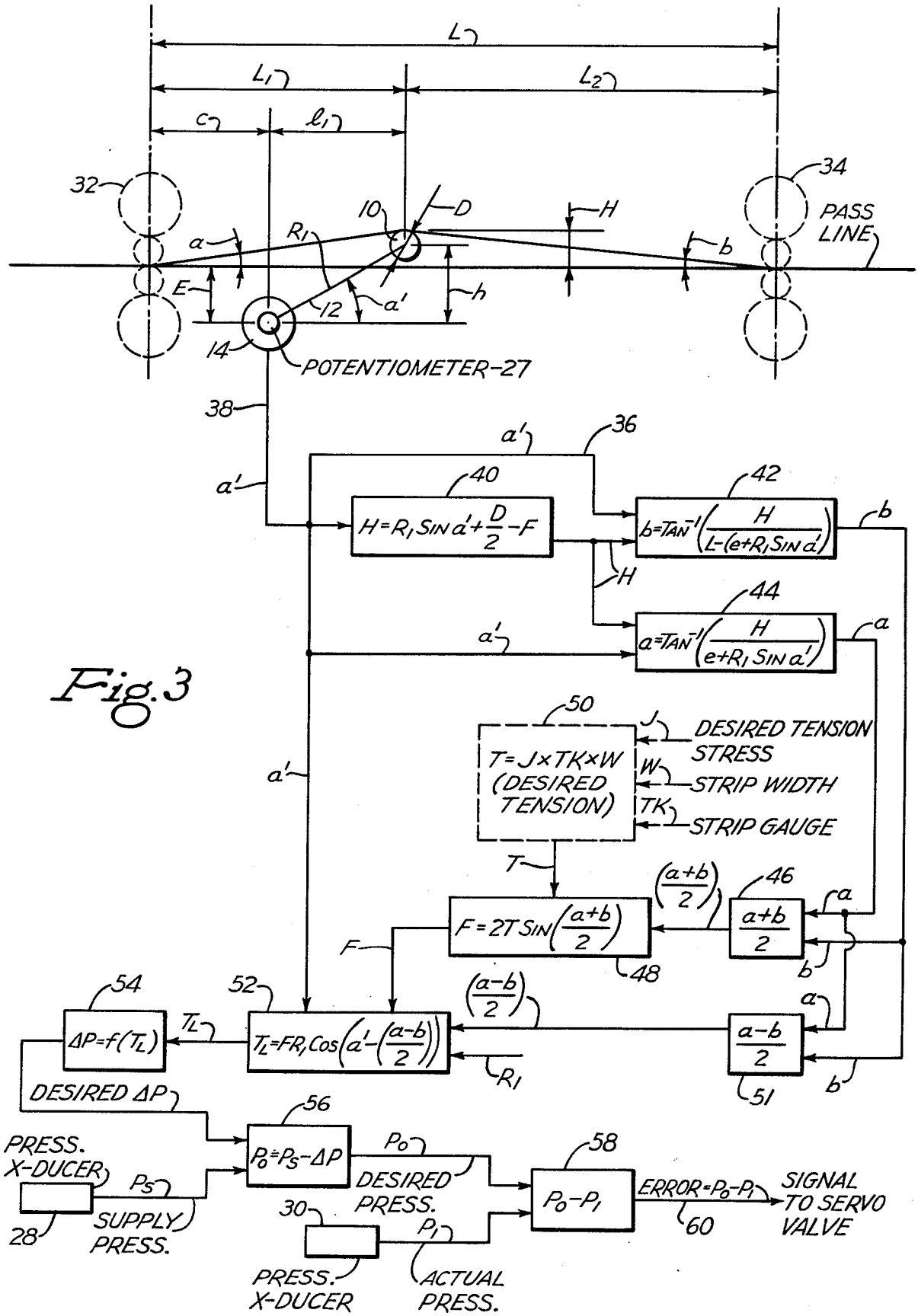
FIG. 3 is a second force diagram in combination with a block diagram of the control system for the present invention.

Before referring to FIG. 3, which illustrates the basic circuitry of the computer that continually solves the equation to produce the required torque for a desired strip tension, reference will be first made to the well-known tension-force diagram of strip loopers which diagram is shown in FIG. 2. The basic equations of the relationship between the required force of the looper roller 10 and the resultant tension in the strip for a given roller or strip position can be briefly set forth as follows: Where T = the strip tension and F = the resultant force on the roller 10:

$$C = a + b$$

$$2A + (a + b) = 180$$

$$\therefore A = 90 - \left[\frac{a+b}{2}\right]$$

$$B = 90 - a$$

$$D = A - B = 90 - \left(\frac{a+b}{2}\right) - 90 + a = \frac{a-b}{2}$$

$$F = 2T\cos 90 - \left[\frac{(a+b)}{2}\right] = 2T\sin\left[\frac{a+b}{2}\right] \quad \text{Equation No. 1}$$

This equation also appears in the aforesaid U.S. Pat. No. 3,169,420 along with some other general background equations. In FIG. 2 the looper roller 10 is arranged between two hot rolling mill stands 32 and 34.

Turning now to FIG. 3, the force tension diagram is again illustrated in order to identify the elements of the equation fed to the analog computer which is identified with the reference character 36. Also shown is the roller 10, actuator 14 and the potentiometer 27 associated therewith arranged between the two 4-high hot rolling mill stands 32 and 34. The computer 36, as noted, is an analog type which follows well-known computer design of the type used in steel mill applications and is designed to receive the necessary input values to enable it to solve Equation No. 1 which expresses looper force against the strip in terms of strip tension and from this equation computes the equivalent required torque that must be delivered from the actuator 14 for a particular looper roller position and a desired strip tension.

Accordingly, and in referring to FIG. 3, the computer 36 receives a value $a'$ from the potentiometer 27 representing the angle $a'$ of FIG. 3 over line 38 and feeds four separate signals of this value to four different circuits. The computer has a circuit 40 which receives one of the $a'$ signals and solves for the value H of the force diagram, the value of H being found by the trigonometrical equation $$H = R_1 \operatorname{Sin} a' + \frac{D}{2} - E$$

which elements are also shown in the force diagram of FIG. 3. Similarly, by a circuit 42 which receives signals of the $a'$ and $H$ values, the angle for $b$ is determined by solving the equation:

$$b = \operatorname{Tan}^{-1}\left(\frac{H}{L - (e + R_1 \operatorname{Sin} a')}\right)$$

In a similar way and by a trigonometrical equation:

$$a = \operatorname{Tan}^{-1}\left(\frac{H}{e + R_1 \operatorname{Sin} a'}\right)$$

the value $a$ is solved for by a circuit 44 of the computer which receives values of $a'$ and H from line 38 and circuit 40. The computer then combines the values $a$ and $b$ in a circuit 46 to produce a signal in the form of $$\frac{a+b}{2}$$

which is sent to a circuit 48 which solves Equation No. 1 which is expressed in legend in FIG. 3.

Figure 4:
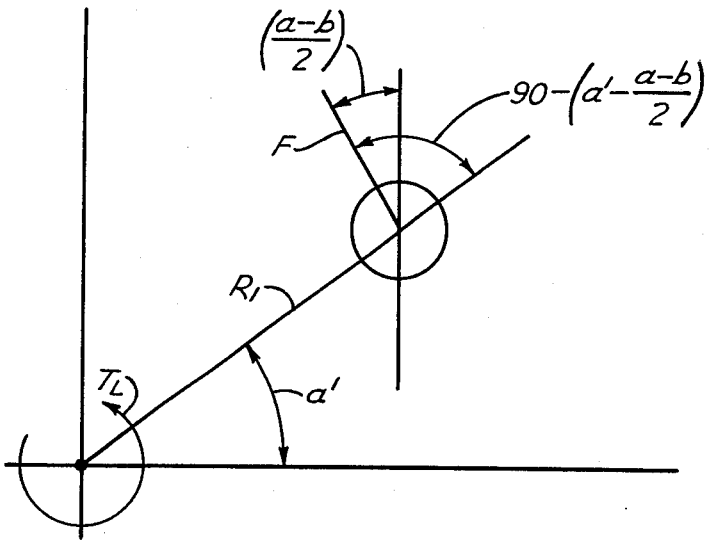
FIG. 4 is a free body diagram of the looper roller and actuator shown in FIGS. 1 and 3.

The circuit 48 receives a signal representing T (Tension) from a circuit 50. As shown in legend, the circuit 50 receives input of the desired tension stress, strip width and strip gauge. The value of F representing the force of the looper roller 10 is fed from the circuit 48 to a circuit 52 which relates the force value to a torque value since the applicator 14 supplies its power through a rotational shaft. The circuit 52 also receives a signal $$\frac{a-b}{2}$$

from a circuit 51 along with a constant value $R_1$ representing the length of the looper arm 12. The derivation of the torque equation is derived with reference to FIG. 4 as follows:

$$T_L - FR_1 \operatorname{Sin}\left\{90 - \left[a' - \frac{(a-b)}{2}\right]\right\} = 0$$

$$T_L = FR_1 \operatorname{Sin}\left\{90 - \left[a' - \frac{(a-b)}{2}\right]\right\}$$

$$T_L = FR_1 \cos\left[a' - \frac{(a-b)}{2}\right]$$

Since the actuator operates on a pressure difference to produce a given torque, a delta ($\Delta$) value is produced by a circuit 54 where the change in the fluid pressure going to the actuator 14 is determined by the equation $\Delta P = f(T_L)$. This value is then compared in a circuit 56 with a value $P_s$ provided by the pressure transducer 28 in the supply line 16 of FIG. 1 to give a signal $P_o$ representing the desired pressure to be sent to the actuator 14. This value is still further modified by comparing it with the actual pressure on the low pressure side in line 26 of the actuator as determined by the pressure transducer 30 as legend $P_1$ and in a circuit 58 is algebraically added to the value of $P_o$ to produce the ultimate error signal which over line 60 is fed to the servovalve 24. Hence, the computer 36 actually computes an error signal representative of the required pressure difference across the input and output sides of the actuator 14 for a desired tension with reference to a given looper roller position.

From the above description of the control of FIG. 3, it can be seen that for a desired strip tension set by the circuit 50 as the looper roller 10 changes its position due to a change in the strip position, the computer 36 will automatically compute the new looper roller force and torque required by the actuator 14 to maintain the tension in the strip constant. Since it is a characteristic of the hydraulic rotary actuator 14 to both maintain an accurate linear relationship between fluid energy input and output and compensate for fluid losses, very simple, but accurate and reliable tension device and control are provided.

In accordance with the provisions of the patent statutes, I have explained the principle and operation of my invention and have illustrated and described what I consider to represent the best embodiment thereof.

I claim:

1. In a tensioning device for continually moving material, such as rolled metallic strip, means arranged to contact one of the surfaces of the strip in a manner to deflect the strip out of a datum path of travel to impose a tension thereon, a fluid actuator means operably connected to said strip contacting means for displacing said strip contacting means towards said strip, said actuating means having two ports, fluid servomeans, means for connecting a first pressure source to one of said ports of said actuator, means for connecting said servo to the other port of said actuator in a manner to establish a pressure difference between said two ports, a computer, means for producing a signal representative of the position of said strip contacting means relative to said datum position and for sending said signal to said computer, said computer including means for employing said signal for calculating the required pressure for said actuator for a desired tension and for controlling the operation of said servo in accordance therewith.

2. In a tension device in accordance with claim 1 wherein said computer includes means for calculating the required pressure difference across said two ports of said actuator for a desired tension.

3. In a strip tensioning device in accordance with claim 2 including means for producing signals representative of the actual pressures at said two ports of said actuator, means for sending these signals to said computer, and said computer, including means for comparing its servocontrol signal with the actual pressure values and to modify its servocontrol signal should the comparison involve a difference to reduce the difference to zero.

4. In a strip tensioning device in accordance with claim 1, including means for supplying a maximum pressure to said port of said actuator and means for connecting said servo to the other said port of said actuator.

5. In a strip tensioning device in accordance with claim 1, wherein said actuator and servomeans are hydraulically operated.

* * * * *